US008933805B2

(12) United States Patent
Kofford et al.

(10) Patent No.: US 8,933,805 B2
(45) Date of Patent: Jan. 13, 2015

(54) ADJUSTABLE TOUCHLESS TRANSMITTER TO WIRELESSLY TRANSMIT A SIGNAL

(75) Inventors: Bradley C. Kofford, Bountiful, UT (US); Luigi Bignotti, Conegliano (IT)

(73) Assignee: Controlled Entry Distributors, Inc., Salt Lake City, UT (US)

( * ) Notice: Subject to any disclaimer, the term of this patent is extended or adjusted under 35 U.S.C. 154(b) by 233 days.

(21) Appl. No.: 13/079,555

(22) Filed: Apr. 4, 2011

(65) Prior Publication Data

US 2012/0249327 A1 Oct. 4, 2012

(51) Int. Cl.

| | |
|---|---|
| ***G08B 1/08*** | (2006.01) |
| ***E05F 15/20*** | (2006.01) |
| *E05F 15/00* | (2006.01) |

(52) U.S. Cl.

CPC ..... *E05F 15/2076* (2013.01); *E05F 15/20232* (2013.01); *E05F 15/00* (2013.01); *G07C 2209/64* (2013.01)

USPC ..... 340/539.23; 340/12.22; 340/561; 340/686.6; 341/176

(58) Field of Classification Search

CPC .... E05F 15/2076; E05F 15/2023; E05F 15/00

USPC ..... 340/539.23, 12.22, 13.24, 561, 565, 340/686.6; 341/176

See application file for complete search history.

(56) References Cited

U.S. PATENT DOCUMENTS

| | | | | |
|---|---|---|---|---|
| 5,926,090 | A * | 7/1999 | Taylor et al. | 340/568.1 |
| 6,023,224 | A * | 2/2000 | Meyvis | 340/545.1 |
| 8,106,749 | B2 * | 1/2012 | Ina et al. | 340/12.22 |
| 2005/0134426 | A1 * | 6/2005 | Mullet et al. | 340/5.7 |
| 2007/0120834 | A1 * | 5/2007 | Boillot | 345/173 |
| 2007/0126552 | A1 * | 6/2007 | Fitzgibbon | 340/5.71 |
| 2012/0119873 | A1 * | 5/2012 | Ramsdell et al. | 340/4.3 |

* cited by examiner

*Primary Examiner* — Steven Lim
*Assistant Examiner* — Hongmin Fan
(74) *Attorney, Agent, or Firm* — Holland & Hart

(57) ABSTRACT

A touchless transmitter is described. The transmitter includes a sensor configured to detect a presence of an object. The transmitter further includes a sensor adjustment mechanism configured to adjust a level of sensitivity of the sensor. The transmitter also includes an antenna configured to wirelessly transmit a signal to a receiver upon detecting the presence of the object, and the transmitter includes an indicator configured to provide an output upon detecting the presence of the object.

15 Claims, 7 Drawing Sheets

ADJUSTABLE TOUCHLESS TRANSMITTER TO WIRELESSLY TRANSMIT A SIGNAL

BACKGROUND

Operating systems exist to control the movement of a barrier. For example, operating systems may control the movement of a garage door, gate, door, and the like. Such systems typically include at least one wireless transmitter and an actuator. The actuator generally includes an electric motor for driving, for example, a screw gear or chain to open or close the barrier. A receiver and controller are also typically provided for receiving signals from the wireless transmitter, and controlling the actuator.

In operation, in order to open or close the barrier, a user activates the transmitter by pressing a button. Upon such activation, the transmitter transmits a wireless, usually radio frequency (RF), signal to the receiver. In response, the controller activates the actuator to open or close the barrier. For security purposes, the receiver may be manually set to recognize the transmitter, such as through switch settings, or the receiver may be pre-set to recognize an identification signal from a particular transmitter. To further improve security, the wireless signal from the transmitter may also be encrypted.

Often times, the requirement to press or touch a button on the transmitter may be difficult to accomplish. For example, a user may be physically constrained from pressing or touching the transmitter to open or close a barrier. In addition, the user may be concerned with infection or other diseases that may be spread by touching a transmitter that is accessible to several other users. As a result, benefits may be realized by providing a touchless transmitter that detects the presence of an object (such as a user) without requiring the user to physically contact the transmitter. In addition, benefits may be realized by allowing the sensing range of the transmitter to be fully adjustable so as to prevent undesired detection of the presence of an object (which may then cause the barrier to open or close). Further, benefits may be realized by providing an adjustable touchless transmitter that wirelessly transmits a signal to a receiver, which may then control the movement of the barrier.

SUMMARY

According to at least one embodiment, a touchless transmitter is described. The transmitter includes a sensor configured to detect a presence of an object. The transmitter further includes a sensor adjustment mechanism configured to adjust a level of sensitivity of the sensor. The transmitter also includes an antenna configured to wirelessly transmit a signal to a receiver upon detecting the presence of the object, and the transmitter includes an indicator configured to provide an output upon detecting the presence of the object.

In one embodiment, the output may indicate a transmission of the signal to the receiver. In one configuration, the output may indicate a detection of the presence of the object. The output may also indicate a power supply of the touchless transmitter is below a threshold.

In one example, the sensor is a touchless sensor to detect the presence of the object. The indicator may be a visual indicator. In one embodiment, the indicator may be an audible indicator. The antenna may wirelessly transmit the signal to the receiver in accordance with a rolling code protocol.

The transmitter may further include a jumper component configured to activate a visual indicator and/or an audible indicator. In one embodiment, the sensor adjustment mechanism may adjust the level of sensitivity between three centimeters and fourteen centimeters.

A method to wirelessly transmit a signal from a touchless transmitter to a receiver when a presence of an object is detected is also described. A presence of the object may be detected by a sensor. A level of sensitivity of the sensor may be adjusted by a sensor adjustment mechanism. The signal may be wirelessly transmitted to the receiver upon detecting the presence of the object. An output may be provided by an indicator upon detecting the presence of the object.

A system to control a movement of a barrier is also described. The system may include a touchless transmitter. The touchless transmitter may include a sensor configured to detect a presence of an object, and a sensor adjustment mechanism to adjust a level of sensitivity of the sensor. The touchless transmitter may further include an antenna configured to wirelessly transmit a signal to a receiver upon detecting the presence of the object. The touchless transmitter may also include an indicator configured to provide an output upon detecting the presence of the object. The system may further include a receiver configured to receive the signal transmitted from the touchless transmitter, and provide a command signal to an actuator of the barrier in accordance with the signal received from the touchless transmitter. The actuator of the barrier may be configured to receive the command signal from the receiver, and activate a movement of the barrier in accordance with the command signal provided by the receiver.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
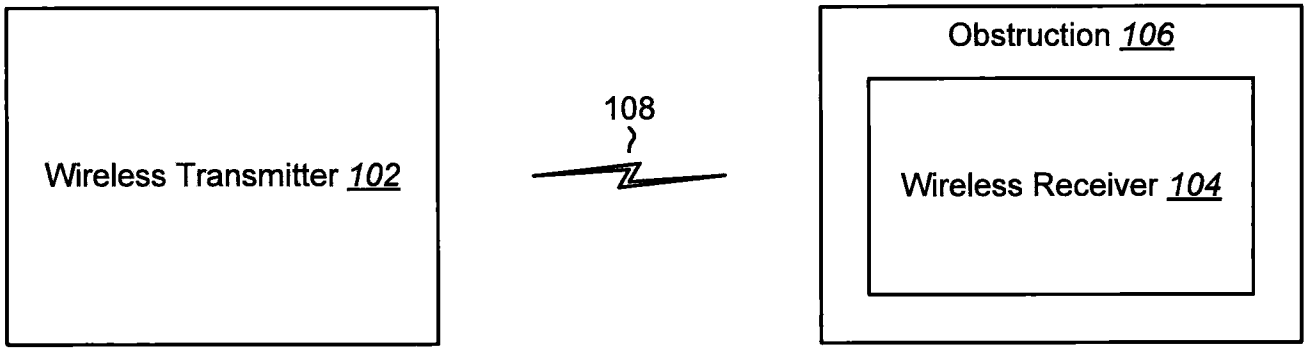
FIG. 1 is a block diagram illustrating one embodiment of an environment in which the present systems and methods may be implemented.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

A transmitter is an electronic device which may, usually with the aid of an antenna, propagates an electromagnetic signal to a receiver. The receiver may comprise an electronic circuit that receives the electromagnetic signal from the transmitter and produces some type of output based on the received signal. In one example, the electromagnetic signal may be transmitted to the receiver via radio waves. As a result, the transmitter and receiver may both operate according to a radio frequency (RF).

Transmitters are used to control gates, garage doors, doors, and many other types of barriers or obstacles. Receivers may be electronically connected to a motor or other type of device to effectuate the movement of a barrier or obstacle. Typically, a user is required to manually press a button on the transmitter in order for the transmitter to transmit a signal to the receiver. The receiver receives the signal and the motor may be actuated to move the barrier or obstacle. In some cases, the user may not be required to manually press a button on the transmitter. For example, the transmitter may include sensing circuitry that senses the presence of a mass (such as a hand, finger, foot, etc.). Upon sensing the presence of a mass, the transmitter may then transmit the signal to the receiver. These types of transmitters may be referred to as touchless transmitters. Touchless transmitters may be connected to receivers via a wired connection. In such configurations, a signal is transmitted from a touchless transmitter to a receiver via the wired connection. In addition, the sensing circuitry in touchless transmitters may not be adjustable. In other words, the range of current sensing circuitry in touchless transmitters may not be adjustable to change the range of detection implemented by the sensing circuitry.

In one embodiment, the present systems and methods provide a touchless transmitter to wirelessly transmit a signal to a receiver. In addition, the present systems and methods provide an adjustable touchless transmitter comprising sensing circuitry that may be adjusted to change the range of detection implemented by the circuitry.

FIG. 1 is a block diagram illustrating one embodiment of an environment in which the present systems and methods may be implemented. In one configuration, a touchless transmitter 102 may wirelessly transmit a signal 108 to a wireless receiver 104. The receiver 104 may be electronically coupled to an obstruction 106 or other type of barrier. Examples of the obstruction 106 may include, but are not limited to, doors, garage doors, gates, windows, barriers, or any other type of barrier or obstruction. The signal 108 may be wirelessly transmitted to the receiver 104 via RF transmission protocols. The receiver 104 may cause the obstruction 106 to perform an action when the signal 108 is received. For example, the receiver 104 may cause the obstruction to move 106 (e.g., open or close) when the signal 108 is received. In one embodiment, the receiver 104 may provide a command signal to an actuator to physically move the obstruction 106. An example of the actuator may include a motor that controls the movement of the obstruction 106.

In one configuration, the signal 108 may be transmitted from the transmitter 102 to the receiver 104 using a rolling code security protocol. In one example, a rolling code (or a hopping code) may be used in keyless entry systems to prevent replay attacks. A replay attack may occur when an unauthorized user records the transmitted signal 108 and transmits it at a later time to the receiver 104. The receiver 104 may then cause an actuator to move (e.g., open or close) the obstruction upon receiving the signal 108. This may result in the unauthorized user gaining access to a location, item, premise, etc. blocked by the obstruction 106. Rolling code security protocol may prevent the unauthorized user from successfully recording the transmitted signal 108. For example, the transmitter 102 and the receiver 104 may include a Pseudo Random Number Generator (PRNG) that randomly generates a sequence of codes. When the transmitter 102 transmits the signal 108, the signal 108 may include the "next" code in the sequence of codes. The receiver 104 may compare the received "next" code to its calculated "next" code. If the received code matches the calculated code, the receiver 104 may cause an actuator to move the obstruction 106. As a result, a signal 108 recorded by an unauthorized user to transmit to the receiver 104 at a later time may not be the correct "next" code according to the rolling code security protocol.

Figure 2:
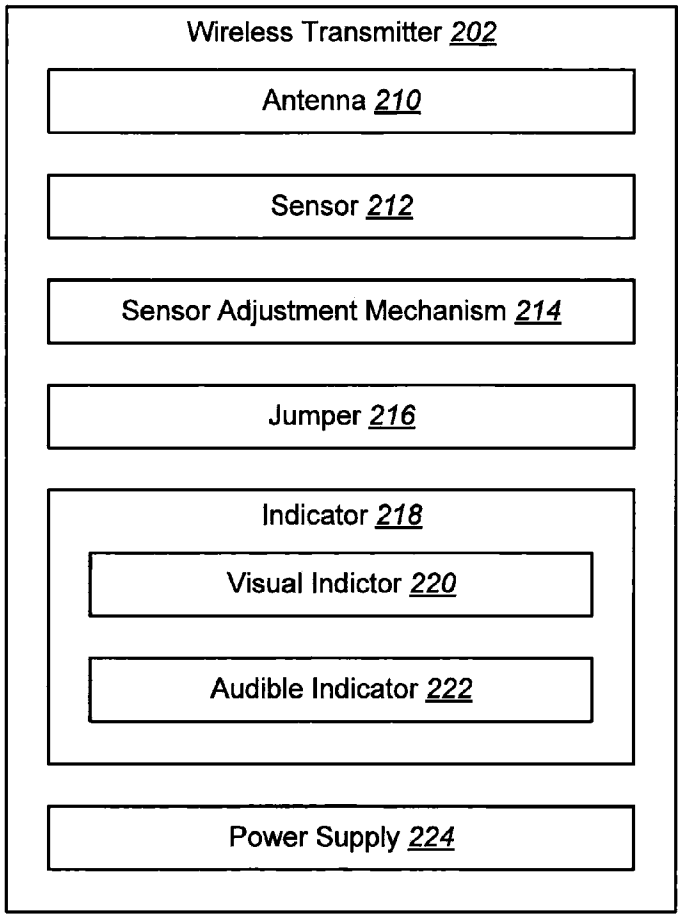
FIG. 2 is a block diagram illustrating one embodiment of a touchless transmitter in accordance with the present systems and methods.

FIG. 2 is a block diagram illustrating one embodiment of a touchless transmitter 202 in accordance with the present systems and methods. The transmitter 202 may include an antenna 210 to transmit a signal 108 to a receiver 104. A sensor 212 may sense the presence of a mass or other object within a certain distance of the touchless transmitter 202. For example, the sensor 212 may sense when a user's hand is within a certain range of the transmitter 202. When the sensor 212 detects the presence of a mass, the antenna 210 may then transmit the signal 108 to the receiver 104.

In one embodiment, the transmitter 202 may also include a sensor adjustment mechanism 214. The mechanism 214 may allow a user to adjust a level of sensitivity of the sensor. In other words, the sensor adjustment mechanism 214 may adjust a sensing range of the sensor 212. For example, the user may adjust the mechanism 214 to increase or decrease the range of the sensor 212. If the range is decreased, the sensor 212 may only detect objects that are within a close proximity to the transmitter 202. If the range is increased via the mechanism 214, the sensor 212 may detect objects that are further away from the transmitter 202. In one configuration, the mechanism 214 may adjust the sensing range from about one centimeter (cm) to about 18 cm, and more specifically, the mechanism 214 may adjust the sensing range of the sensor 212 to about three cm to about 14 cm.

In one configuration, the transmitter 202 may further include an indicator 218. The indicator 218 may include a visual indicator 220 and/or an audible indicator 222. The indicator 218 may be activated with the signal 108 is transmitted from the transmitter 202. In addition, the indicator 218 may be activated when the sensor 212 detects the presence of a mass in the range of the transmitter 202. If the visual indicator 220 is activated, a light emitting diode (LED) may be activated while the signal 108 is being transmitted. If the audible indicator 222 is activated, a beep or other audible sound may be outputted from the transmitter 202 while the signal 108 is being transmitted. A jumper 216 may allow a user of the transmitter 202 to activate/deactivate the visual indicator 220 and the audible indicator 222. In other words, the jumper 216 may allow the user to select which type of indicator 218 to activate during the transmission of the signal 108.

In one example, the transmitter may further include a power supply 224. The power supply 224 may be a battery that supplies power to the touchless transmitter 202. In another embodiment, the transmitter 202 may be solar powered and not require the power supply 224 to be included within the transmitter 202. In one configuration, the indicator 218 may provide an output when the power supply is below a predetermined threshold.

Figure 3:
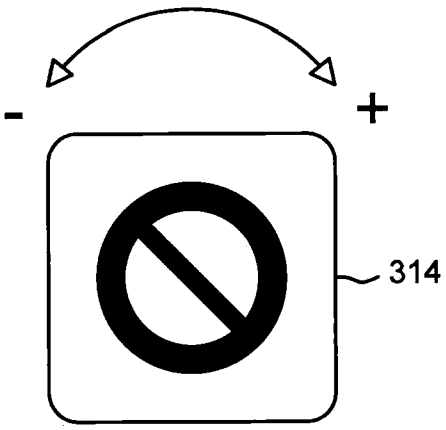
FIG. 3 is a block diagram illustrating one embodiment of an adjustment trimmer component that may be included in the transmitter in accordance with the present systems and methods.

FIG. 3 is a block diagram illustrating one embodiment of a sensor adjustment mechanism 314 that may be included in the transmitter 102 in accordance with the present systems and methods. As previously described, a user may adjust the range of the sensor 212 that detects the presence of a mass near the transmitter 102. For example, the user may adjust the mechanism 314 in a clockwise direction to increase the sensing range of the sensor 212. In another embodiment, the user may adjust the mechanism 314 in a counter-clockwise direction to decrease the sensing range of the sensor 212. It is to be understood that other adjustment mechanisms may be used to adjust the sensing range of the sensor 212.

Figure 4:
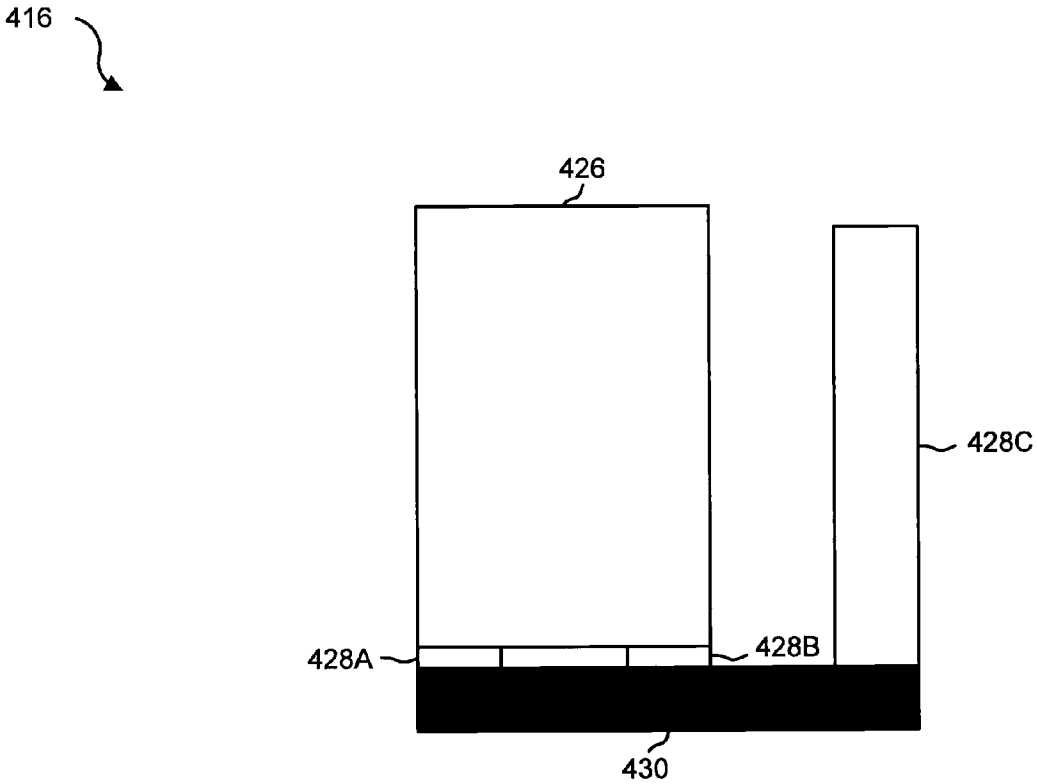
FIG. 4 is a block diagram illustrating one embodiment of a jumper that may be included in the touchless transmitter.

FIG. 4 is a block diagram illustrating one embodiment of a jumper 416 that may be included in the touchless transmitter 102. In one configuration, the jumper 416 may be used to determine whether a visual indicator 220 or an audible indicator 222 is active. For example, the jumper 416 may include a base 430 and a plurality of pins 428A, 428B, 428C. The jumper 416 may also include a cover 426. The user may place the cover 426 over a certain configuration of pins 428A, 428B, 428 to activate the visual indicator 220. As a result, when the transmitter 202 detects the presence of a mass and transmits the signal 108 to the receiver 104, the active visual indicator 220 may be in the form of an LED blinking, flashing, or the like to indicate to the user that the signal 108 is being transmitted.

Figure 5:
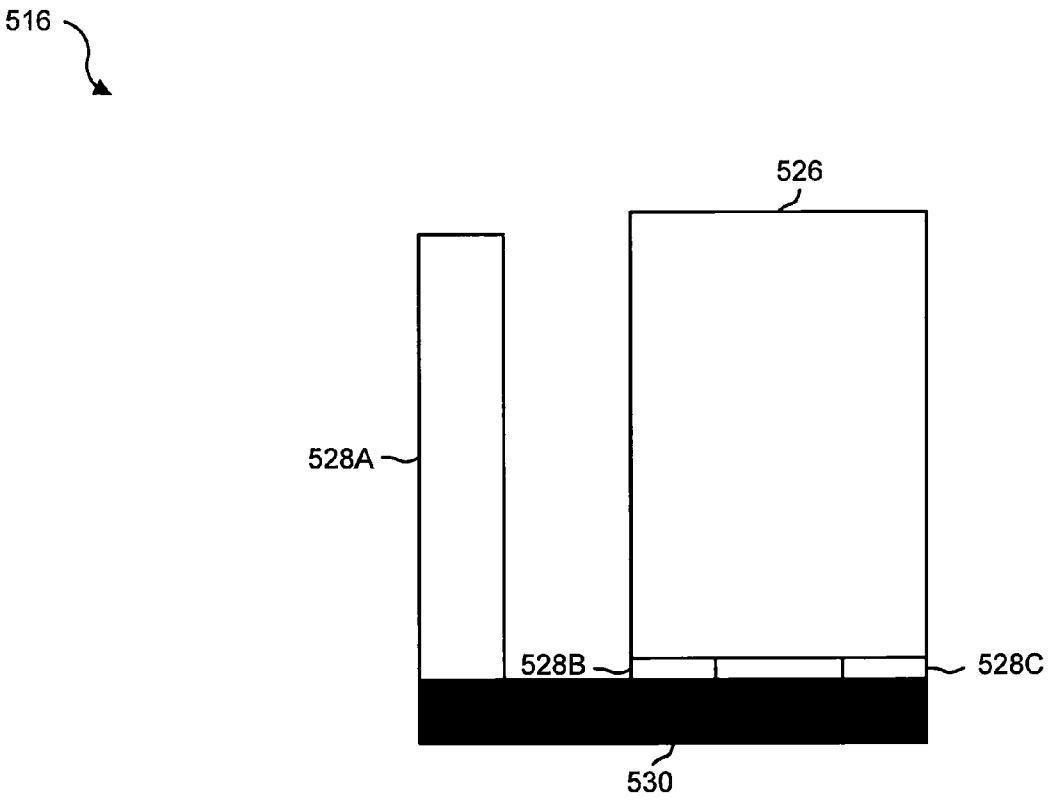
FIG. 5 is a block diagram illustrating another embodiment of a jumper that may be included in the touchless transmitter.

FIG. 5 is a block diagram illustrating another embodiment of a jumper 516 that may be included in the touchless transmitter 102. As illustrated, a cover 526 of the jumper 516 may be placed over a difference configuration of pins 528A, 528B, 528C than the configuration of pins 428A, 428B, 428C illustrated in FIG. 4. As a result, the cover 526 placed over the configuration of pins 528A, 528B, 528C illustrated in FIG. 5 may cause the audible indicator 222 to be activated. When the transmitter 102 detects the presence of a mass and transmits the signal 108 to the receiver 104, the active audible indicator 222 may be in the form of an audible beep or some other audible noise that is outputted to the user to indicate that the signal 108 is being transmitted to the receiver 104.

Figure 6:
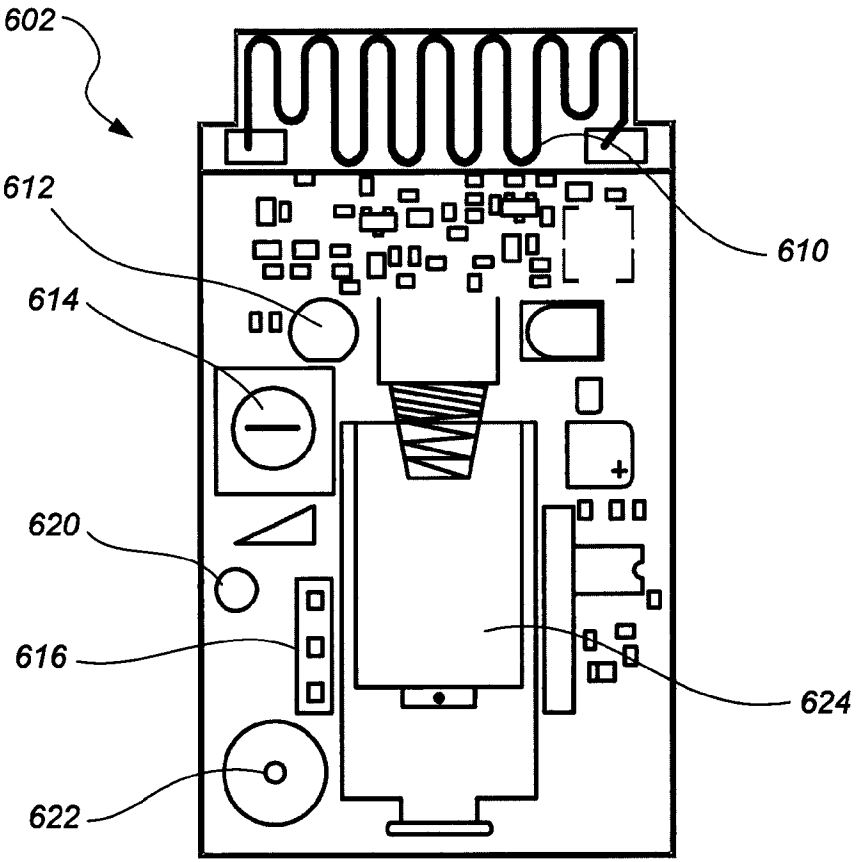
FIG. 6 is a block diagram illustrating one embodiment of various components that may be includes in a touchless transmitter.

FIG. 6 is a block diagram illustrating one embodiment of various components that may be includes in a touchless transmitter 602, in accordance with the present systems and methods. In one configuration, the transmitter 602 may include a sensor 612 to sense the presence of a mass that is within a predetermined range of the transmitter 602. In one example, the predetermined range may be adjusted via a sensor adjustment mechanism 614. For example, a user may rotate (or otherwise adjust) the mechanism 614 to increase or decrease the predetermined range for which the sensor 612 detects the presence of a mass.

When the sensor 612 detects the presence of a mass, a visual indicator 620 and/or an audible indicator 622 may be activated. In one example, the transmitter 602 may be a touchless transmitter that does not require the mass to actually touch the transmitter 602 in order for the sensor 612 to detect the presence of the mass. The visual indicator 620 may be an LED that blinks or otherwise indicates to the user that a presence of a mass is being detected by the sensor 612. The audible indicator 622 may include a beeping noise or other type of indicator to indicate to the user that the sensor 612 is detecting the presence of a mass within the predetermined range of the sensor 612. The user may select whether to activate the visual indicator 620 or the audible indicator 622 via a jumper 616.

In one configuration, an antenna 610 may be used to transmit a signal 108 to a receiver 108 that indicates the detection of a mass by the sensor 612. The signal 108 may be sent wirelessly from the transmitter 602 to the receiver 104. The visual indicator 620 and/or the audible indicator 622 (depending on which one is activated via the jumper 616) may provide an indication to the user during the transmission of the signal 108. When the transmission of the signal 108 is complete (i.e., the sensor 612 no longer detects the presence of a mass), the visual indicator 620 and/or the audible indicator 622 may stop providing an indication to the user. In one embodiment, the transmitter 602 may further include a power supply 624. The power supply 624 may be a lithium battery to provide power to the transmitter 602. In one configuration, the visual indicator 620 and/or the audible indicator 622 may also provide an output to the user to indicate that the power supply 624 is below a certain threshold. In other words, the visual indicator 620 and/or the audible indicator 622 may notify the user as to when the battery of the transmitter 602 is low on power and should be replaced with another battery.

Figure 7:
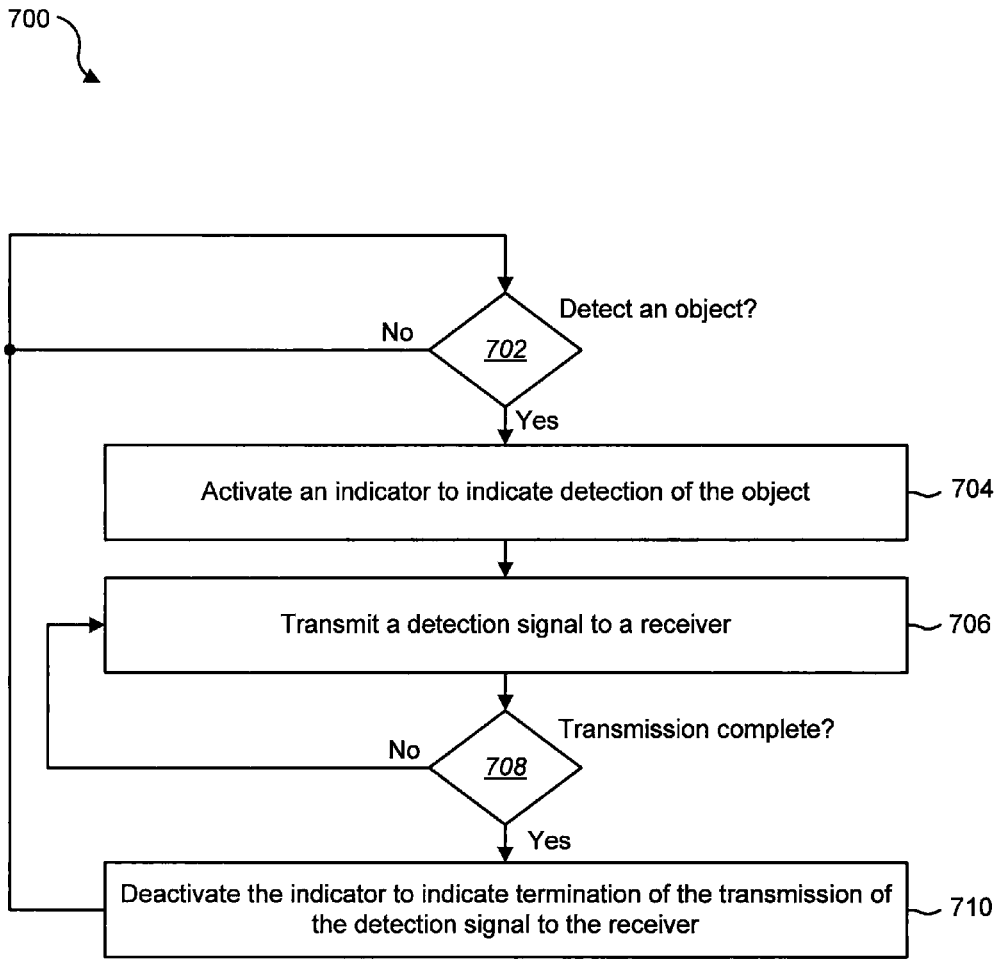
FIG. 7 is a flow diagram illustrating one embodiment of a method to detect the presence of an object and wirelessly transmit a signal regarding the detection.

FIG. 7 is a flow diagram illustrating one embodiment of a method 700 to detect the presence of an object and wirelessly transmit a signal regarding the detection. In one example, the method 700 may be implemented by the touchless transmitter 102.

In one configuration, a determination 702 may be made as to whether an object is detected. If it is determined 702 that an object has not been detected, the method 700 may continue to monitor for the detection of an object. In one example, a sensor 212 used to detect the object may be adjusted to increase or decrease the range of the sensor. If it is determined 702 that an object is detected, an indicator may be activated 704 to indicate the detection of the object. In one example, a detection signal may be wirelessly transmitted 706 to a receiver. A determination 708 may be made as to whether the transmission is complete. If it is determined 708 that the transmission is not complete, the method 700 may continue to transmit 706 the detection signal to the receiver. If, however, it is determined 708 that the transmission is complete, the indicator may be deactivated 710 to indicate termination of the transmission of the detection signal to the receiver.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered exemplary in nature since many other architectures can be implemented to achieve the same functionality.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

Furthermore, while various embodiments have been described and/or illustrated herein in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may configure a computing system to perform one or more of the exemplary embodiments disclosed herein.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present systems and methods and their practical applications, to thereby enable others skilled in the art to best utilize the present systems and methods and various embodiments with various modifications as may be suited to the particular use contemplated.

Unless otherwise noted, the terms "a" or "an," as used in the specification and claims, are to be construed as meaning "at least one of" In addition, for ease of use, the words "including" and "having," as used in the specification and claims, are interchangeable with and have the same meaning as the word "comprising."

What is claimed is:

1. A touchless transmitter for controlling access to a location, comprising:

a sensor configured to detect a presence of an object within a predetermined sensing range to control a structural barrier controlling access to a location;

a sensor adjustment device configured to selectively increase and decrease the sensing range of the sensor in which the presence of the object is detected to control the structural barrier, the sensor adjustment device being adjustable to increase and decrease the predetermined sensing range by moving a portion of the sensor adjustment device;

upon detecting the presence of the object within an adjusted sensing range of the sensor, an antenna configured to wirelessly transmit a signal to a receiver, the receiver configured to control access to the location through movement of the structural barrier, the signal being transmitted in order to control the structural barrier; and an indicator configured to provide an output from at least one of a visual indicator and an audible indicator, the visual indicator including a light, the output being provided upon detecting the presence of the object within the adjusted sensing range of the sensor at least when configured to control the structural barrier controlling access to the location, the output of the indicator further indicates a transmission of the signal to the receiver, and the indicator configured to deactivate the output only upon termination of the transmission of the detection signal to the receiver;

a power supply providing power to the touchless transmitter, the output of the indicator indicating when the power supply is below a threshold.

2. The touchless transmitter of claim 1, wherein the sensor comprises a touchless sensor to detect the presence of the object.

3. The touchless transmitter of claim 1, wherein the indicator comprises at least one visual indicator and at least one audible indicator.

4. The touchless transmitter of claim 1, wherein the indicator comprises either the visual indicator or the audible indicator.

5. The touchless transmitter of claim 1, wherein the antenna is further configured to wirelessly transmit the signal to the receiver in accordance with a rolling code protocol.

6. The touchless transmitter of claim 1, further comprising a jumper component configured to activate at least one of the visual indicator and the audible indicator.

7. The touchless transmitter of claim 1, wherein the sensor adjustment device selectively increases or decreases the predetermined sensing range from about three centimeters and about fourteen centimeters.

8. A method to wirelessly transmit a signal from a touchless transmitter to a receiver when a presence of an object is detected for controlling access to a location based upon transmissions, the method comprising:

detecting, by a sensor, a presence of an object to control a structural barrier controlling access to a location;

selectively increasing and decreasing a predetermined range of sensitivity of the sensor by moving a portion of a sensor adjustment device, the predetermined range of sensitivity of the sensor being the range in which the presence of the object is detected to control the structural barrier;

upon detecting the presence of the object within an adjusted range of sensitivity of the sensor, wirelessly transmitting, by an antenna, a signal to the receiver in order to control a structural barrier, the receiver configured to control access to the location through movement of the structural barrier, the signal being transmitted in order to control the structural barrier;

providing, by an indicator, an output from at least one of a visual indicator and an audible indicator, the visual indicator including a light, the output being provided upon detecting the presence of the object within the adjusted sensing range of the sensor at least when configured to control the structural barrier controlling access to the location;

deactivating the output only upon termination of the transmission of the detection signal to the receiver;

activating the output of the indicator to indicate a transmission of the signal to the receiver;

providing power to the touchless transmitter with a power supply, the output of the indicator indicating when the power supply is below a threshold.

9. The method of claim 8, wherein the sensor comprises a touchless sensor to detect the presence of the object.

10. The method of claim 8, wherein the indicator comprises at least one visual indicator and at least one audible indicator.

11. The method of claim 8, wherein the indicator comprises either the visual indicator or the audible indicator.

12. The method of claim 8, further comprising wirelessly transmitting, by the antenna, the signal to the receiver in accordance with a rolling code protocol.

13. The method of claim 8, wherein the predetermined sensing range is between about three centimeters and about fourteen centimeters.

14. A system to control a movement of a barrier controlling access to a location, the system comprising:

a touchless transmitter, comprising:

a touchless sensor configured to detect a presence of an object within a predetermined sensing range;

a sensor adjustment device configured to selectively increase and decrease an adjusted sensing range of the sensor in which the presence of the object is detected to control access to a location, the sensor adjustment device being adjustable to increase and decrease the adjusted sensing range by physically contacting and moving a portion of the sensor adjustment device;

upon detecting the presence of the object within the adjusted sensing range of the sensor, an antenna configured to wirelessly transmit a signal upon detecting the presence of the object, the signal following a rolling code protocol;

an indicator configured to provide an output from at least one of a visual indicator and an audible indicator, the visual indicator including a light, the output being provided upon detecting the presence of the object within the adjusted sensing range of the sensor at least when configured to control access to the location, the output of the indicator further indicates a transmission of the signal to the receiver, the indicator configured to deactivate the output only upon termination of the transmission of the detection signal to the receiver;

a jumper comprising three leads and a cover, the jumper selectively activating at least one of the visual indicator and the audible indicator based on the position of the cover on the jumper connecting two out of the three leads; and a power supply providing power to the touchless transmitter, the output of the indicator configured to blink to indicate when the power supply is below a threshold;

a movable structural barrier controlling access to the location;

a receiver configured to control access to the location through movement of the structural barrier by:

receiving the wirelessly transmitted signal from the touchless transmitter; and providing a move command in accordance with the signal received from the touchless transmitter to grant access to the location by moving the structural barrier; and an actuator of the movable structural barrier configured to:

receive the move command from the receiver; and actuate a movement of the movable structural barrier in accordance with the move command provided by the receiver.

15. The method of claim 8, wherein the range of sensitivity of the sensor is selectively increased or decreased by rotating an electronic component of the sensor adjustment device.

* * * * *